US008434413B2

(12) United States Patent
Mitsunabe et al.

(10) Patent No.: US 8,434,413 B2
(45) Date of Patent: May 7, 2013

(54) GAS GENERATOR

(75) Inventors: Atsushi Mitsunabe, Hyogo (JP); Shingo Oda, Hyogo (JP)

(73) Assignee: Daicel Chemical Industries, Ltd., Osaka (JP)

( * ) Notice: Subject to any disclaimer, the term of this patent is extended or adjusted under 35 U.S.C. 154(b) by 2 days.

(21) Appl. No.: 13/192,585

(22) Filed: Jul. 28, 2011

(65) Prior Publication Data

US 2012/0024186 A1 Feb. 2, 2012

Related U.S. Application Data

(60) Provisional application No. 61/368,951, filed on Jul. 29, 2010.

(30) Foreign Application Priority Data

Jul. 29, 2010 (JP) ..... 2010-170360

(51) Int. Cl.
*F42B 3/103* (2006.01)

(52) U.S. Cl.
USPC ..... 102/530; 102/202.12; 102/202.14

(58) Field of Classification Search ..... 102/202.5, 102/202.9, 202, 12, 202.14, 530; 280/806; 297/480
See application file for complete search history.

(56) References Cited

U.S. PATENT DOCUMENTS 2,853,012 A 9/1958 Rotkin et al.
4,621,578 A 11/1986 Vallieres et al.
5,634,660 A * 6/1997 Fink et al. ..... 280/741
5,924,728 A 7/1999 Evans et al.
6,220,163 B1 * 4/2001 Duguet et al. ..... 102/202.2
6,820,556 B1 * 11/2004 Oda ..... 102/202.7
6,823,796 B1 11/2004 Amano
7,370,885 B2 * 5/2008 Stevens ..... 280/741
7,726,241 B2 * 6/2010 Stevens ..... 102/202.12
7,752,969 B2 * 7/2010 Stevens ..... 102/202.12
8,176,851 B2 * 5/2012 Kodama et al. ..... 102/530

(Continued)

FOREIGN PATENT DOCUMENTS

EP 1 043 201 A2 10/2000
EP 1 043 201 A3 10/2000

(Continued)

OTHER PUBLICATIONS

International Search Report issued in International Patent Application No. PCT/JP2011/066626 on Oct. 24, 2011.

*Primary Examiner* — Bret Hayes
*Assistant Examiner* — Joshua Freeman
(74) *Attorney, Agent, or Firm* — Birch, Stewart, Kolasch, Birch, LLP

(57) ABSTRACT

The present invention provides a gas generator including:
an igniter,
a collar for holding the igniter, and
a cup-shaped case fixed to the collar and charged inside with gas generating agent,
the collar formed by a combination of a metallic portion and a resin portion which is integrated with the metallic portion, the collar being provided with an annular groove formed in an outer peripheral surface thereof,
the cup-shaped case and the collar being fixed by fitting a bent portion, which is obtained by bending inward an end portion in an opening side of the cup-shaped case, to the annular groove,
an annular space being formed by an inner wall surface of the bent portion and the collar, and being in communication with an inside of the cup-shaped case.

8 Claims, 5 Drawing Sheets

U.S. PATENT DOCUMENTS

| | | | | |
|---|---|---|---|---|
| 2002/0162476 | A1* | 11/2002 | Parker et al. | 102/530 |
| 2004/0160046 | A1* | 8/2004 | Tanaka et al. | 280/741 |
| 2004/0226472 | A1 | 11/2004 | Oda | |
| 2004/0232679 | A1* | 11/2004 | Kubo et al. | 280/741 |
| 2004/0245753 | A1 | 12/2004 | Kato et al. | |
| 2004/0250542 | A1* | 12/2004 | Nishina | 60/632 |
| 2005/0039623 | A1* | 2/2005 | Furusawa et al. | 102/202.7 |
| 2005/0126417 | A1* | 6/2005 | Parker et al. | 102/202.12 |
| 2005/0189753 | A1* | 9/2005 | Kato et al. | 280/741 |
| 2006/0150855 | A1* | 7/2006 | Maruyama et al. | 102/202.14 |
| 2006/0208474 | A1* | 9/2006 | Kubo et al. | 280/806 |
| 2007/0096451 | A1* | 5/2007 | Stevens | 280/806 |
| 2007/0145732 | A1* | 6/2007 | Stevens | 280/806 |
| 2007/0163457 | A1* | 7/2007 | Matsumura et al. | 102/202.7 |
| 2011/0210535 | A1* | 9/2011 | Koike et al. | 280/741 |
| 2012/0048137 | A1* | 3/2012 | Hagihara et al. | 102/530 |

FOREIGN PATENT DOCUMENTS

| | | | |
|---|---|---|---|
| EP | 1 227 016 | A1 | 7/2002 |
| FR | 2 557 689 | A1 | 12/1983 |
| JP | 2001-106017 | A | 4/2001 |
| JP | 2002239371 | A | 8/2002 |
| JP | 2003-161599 | A | 6/2003 |
| JP | 2004-217059 | A | 8/2004 |

* cited by examiner

GAS GENERATOR

This nonprovisional application claims priority under 35 U. S. C. §119 (a) to Patent Application No. 2010-170360 filed in Japan on 29 Jul. 2010 and 35 U. S. C. §119(e) to U. S. Provisional Application No. 61/368,951 filed on 29 Jul. 2010, both of which are incorporated by reference.

BACKGROUND OF INVENTION

1. Field of Invention

The present invention relates to a gas generator suitable for a seat belt pretensioner of a vehicle or the like.

2. Background of Invention

A seat belt pretensioner has a mechanism driven by gas generated by a gas generator to retract a seat belt. A small gas generator, which accommodates an igniter and a gas generating agent in a case, is known as a gas generator used in a seat belt pretensioner. In order for a pretensioner to function properly, gas from the gas generator has to be supplied to the pretensioner without any leakage.

JP-A No. 2002-239371 and JP-A No. 2001-106017 disclose examples of a gas generator that is used in a seat belt pretensioner.

JP-A No. 2002-239371 discloses a reinforcement member 7 that is integrally formed with a holder 6, as a structure for fixing a cup body 3 that houses a gas generating agent 2. The reinforcement 7 is integrated by insert-molding with an outer peripheral portion of the holder 6 that is made of resin.

JP-A No. 2001-106017 discloses a structure including a ring body 4 press-fitted to an outer periphery of a holder 3 that is made of resin. The ring body 4 holds a cylindrical container 1 for a gas generating agent P, and can be fixed using screws or bolts in addition to fixing by press-fitting.

SUMMARY OF INVENTION

The invention provides a gas generator including:

an igniter, a collar for holding the igniter, and a cup-shaped case fixed to the collar and charged inside with gas generating agent, the collar formed by a combination of a metallic portion and a resin portion which is integrated with the metallic portion, the collar being provided with an annular groove formed in an outer peripheral surface thereof, the cup-shaped case and the collar being fixed by fitting a bent portion, which is obtained by bending inward an end portion in an opening side of the cup-shaped case, to the annular groove, an annular space being formed by an inner wall surface of the bent portion and the collar, and being in communication with an inside of the cup-shaped case.

BRIEF DESCRIPTION OF THE DRAWINGS

The present invention will be become more fully understood from the detailed description given hereinbelow and the accompanying drawings which are given by way of illustration only, and thus are not limitative of the present invention and wherein:

In FIG. 1, (*a*) shows an axial cross-sectional view showing an assembly method of a gas generator according to the present invention, and (*b*) shows an axial cross-sectional view showing a structure of a gas generator according to the present invention;

In FIG. 5, (*a*) shows an axial half cross-sectional view thereof, and (*b*) shows a partial enlarged view of FIG. 5(*a*) (without a cup-shaped case).

DETAILED DESCRIPTION OF INVENTION

Figure 1:
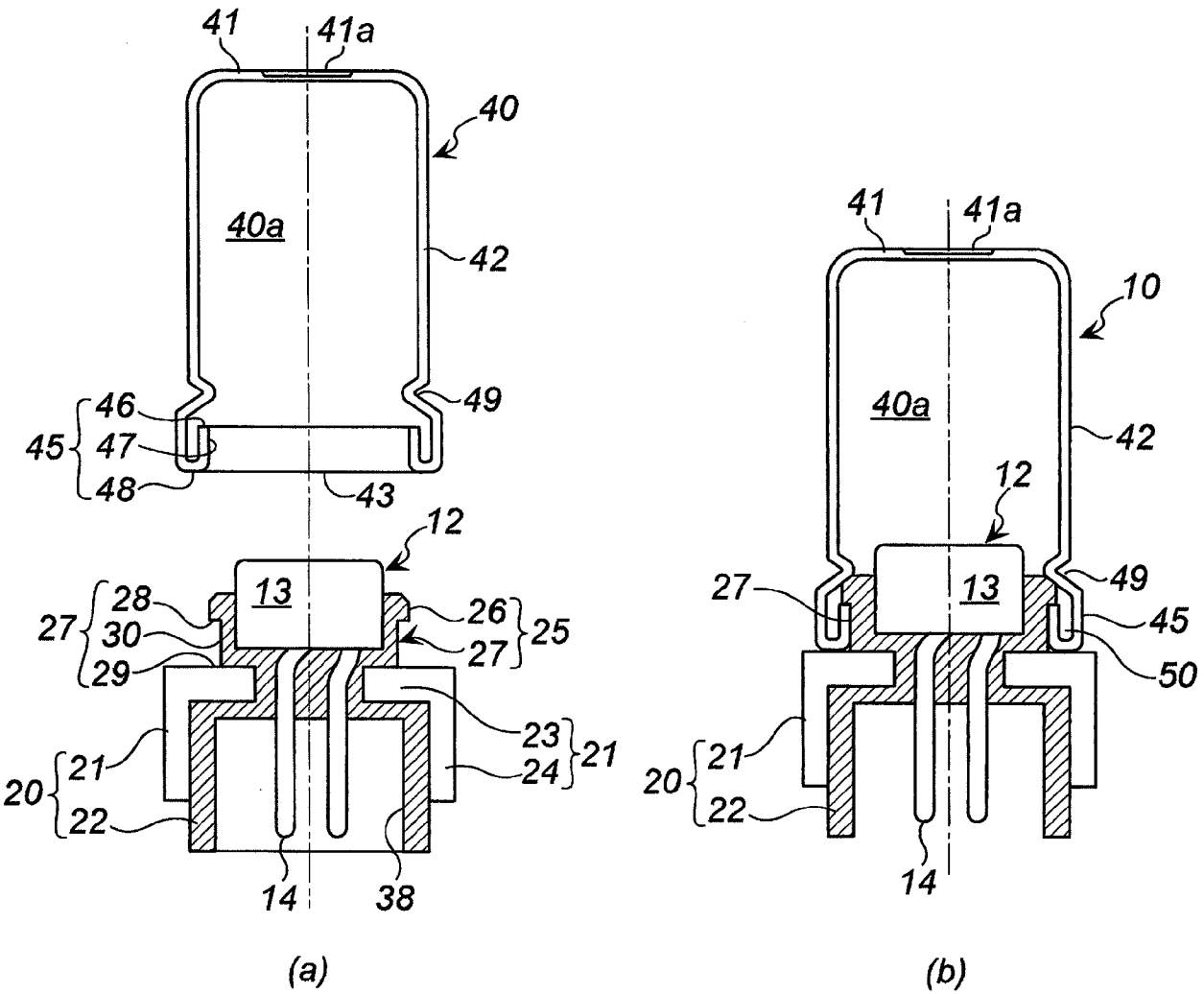
FIG. 1 shows a gas generator according to the present invention.

With the gas generators according to JP-A No. 2002-239371 and JP-A No. 2001-106017, if a force that pushes the reinforcement member 7 or the ring body 4 outward acts when pressure inside the cup body or the cylindrical container increases due to pressure generated upon actuation, a gap is likely to be formed between the reinforcement member 7 or the ring body 4 and the holder. In addition, adopting screwing or bolting in JP-A No. 2001-106017 adds additional processing and increases the number of parts, and therefore leaves much room for improvement from the perspective of a simple structure or manufacturing method.

The present invention provides a gas generator which is easily assembled and that does not leak gas during actuation.

The present invention provides preferable embodiments 2 to 8 as follows:

2. The gas generator of the invention, wherein the bent portion includes an inner opening peripheral edge, an inner annular peripheral surface, and an annular bent corner portion, which are located inside the cup-shaped case, the annular groove of the collar includes an upper annular peripheral surface, a lower annular peripheral surface, and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove and abutting the annular bent corner portion of the bent portion against the lower annular peripheral surface of the annular groove.

3. The gas generator, wherein the bent portion includes an inner opening peripheral edge, an inner annular peripheral surface, and an annular bent corner portion, which are located inside the cup-shaped case, the annular groove of the collar includes an upper annular peripheral surface, a lower annular peripheral surface, and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove and abutting the inner annular peripheral surface of the bent portion against the annular wall surface of the annular groove.

4. The gas generator, wherein the bent portion includes an inner opening peripheral edge, an inner annular peripheral surface, and an annular bent corner portion, which are located inside the cup-shaped case, the annular groove of the collar includes an upper annular peripheral surface, a lower annular peripheral surface, and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove, abutting the inner annular peripheral surface of the bent portion against the annular wall surface of the annular groove, and abutting the annular bent corner portion of the bent portion against the lower annular peripheral surface of the annular groove.

5. The gas generator of embodiment 2, wherein the bent portion includes an inner opening peripheral edge, an inner annular peripheral surface, and an annular bent corner portion, which are located inside the cup-shaped case, the annular groove of the collar includes an upper annular peripheral surface, a lower annular peripheral surface and an annular wall surface connecting the upper annular peripheral surface and the lower annular peripheral surface, and at least one of the annular wall surface and the lower annular peripheral surface is formed with the metallic portion of the collar.

6. The gas generator, wherein the cup-shaped case has a plurality of protrusions projected inward from a peripheral wall portion thereof, and the plurality of protrusions are abutted against the collar.

7. The gas generator, further comprising:

a plurality of protrusions provided in the peripheral wall portion of the cup-shaped case;

a cylindrical wall portion provided in the resin portion for enclosing and fixing an igniter portion of the igniter, the cylindrical wall portion including an annular convex portion formed on an outer peripheral surface thereof, wherein an inner diameter defined by the protrusions is slightly smaller than an outer diameter of the annular convex portion.

8. The gas generator of embodiment 7, wherein the cup-shaped case is fixed to the collar such that the protrusions are brought into press-contact against the annular convex portion.

The invention provides use of the gas generator for a seat belt pretensioner or a seat belt retractor.

The igniter is a known electrical igniter used in a gas generator for a seat belt pretensioner or an air bag apparatus, and includes at least an ignition portion and an electro-conductive pin.

The collar is also a known component used in a gas generator, including a metallic portion and a resin portion integrated by injection molding. The collar holds the igniter in a state where the igniter is surrounded by the resin portion.

The inside of the cup-shaped case is charged with a known gas generating agent. In the present invention, an elastic cup-shaped case made of metal such as stainless steel, iron, or the like or a plastic-deformable cup-shaped case can be used because it is mounted easily to the collar.

The annular groove of the collar may be formed only in one of the metallic portion and the resin portion or may be formed in both the metallic portion and the resin portion.

In the cup-shaped case, a peripheral wall near an opening is bent inward, and the case is mounted by fitting the bent portion into the annular groove of the collar.

In order to increase fitting strength of the bent portion into the annular groove of the collar, preferably, an inner diameter size of the bent portion and an outer diameter size of the annular groove are adjusted (the inner diameter size<the outer diameter size) so that an abutting portion comes into press-contact when fitting the cup-shaped case into the annular groove.

When the cup-shaped case is fitted into the collar, an annular space in communication with the inside of the cup-shaped case is formed by the bent portion and the collar.

During actuation, since gas (gas pressure) generated by combustion of the gas generating agent inside the cup-shaped case, uniformly pushes a wall surface which forms the annular space (a surface of the bent portion and a surface of the collar), bonding strength between the bent portion and the collar is increased and thereby functions to prevent leakage of gas.

The bent portion of the cup-shaped case may include an inner opening peripheral edge, an inner annular peripheral surface, and an annular bent corner portion, which are located inside the cup-shaped case.

The annular groove of the collar may include an upper annular peripheral surface, a lower annular peripheral surface, and an annular wall surface that connects these surfaces.

A contact state between the bent portion of the cup-shaped case and the annular groove of the collar can be set, by selecting from the three embodiments listed below, to any of a combination of all of (i), (ii), and (iii), a combination of (i) and (ii), and a combination of (i) and (iii). The bent portion is abutted against the annular groove or the bent portion is attached to the annular groove as specified below in the invention.

(i) The inner opening peripheral edge of the bent portion is abutted against the upper annular peripheral surface of the annular groove.

(ii) The inner annular peripheral surface of the bent portion is abutted against the annular wall surface of the annular groove.

(iii) The annular bent corner portion of the bent portion is abutted against the lower annular peripheral surface of the annular groove.

The cup-shaped case can be shaped to have a plurality of protrusions that project inward from the peripheral wall portion. By abutting the protrusions against the collar (preferably, by bringing into press-contact), reinforcement can be achieved to increase fixing strength of the cup-shaped case to the collar.

With the gas generator according to the present invention, when pressure inside the case increases due to gas generated upon actuation, an attaching force at a fitting portion between the cup-shaped case and the collar increases. Therefore, a gap is not created at the fitting portion during actuation and leakage of generated gas can be prevented.

Figure 2:
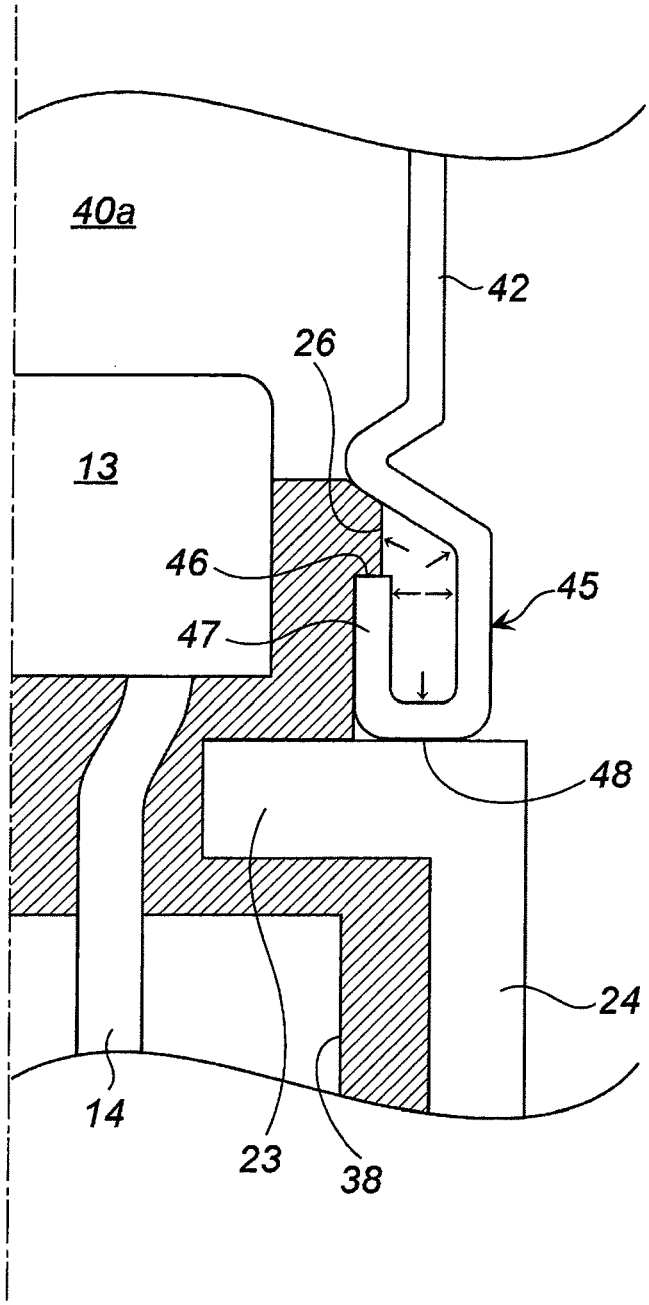
FIG. 2 shows a partial enlarged view of the gas generator shown in FIG. 1.

EMBODIMENTS OF INVENTION (1) Gas Generator Shown in FIGS. 1 and 2

An embodiment of a gas generator 10 according to the present invention will be described with reference to FIG. 1. The gas generator 10 shown in FIG. 1 is suitable for a gas generator used in a seat belt retractor.

In the gas generator 10 according to the present invention, an electrical igniter 12 is fixed to a collar 20 and a cup-shaped case 40 is further fixed to the collar 20.

The igniter 12 is commonly used in a gas generator for an air bag system or a seat belt retractor and has an ignition portion 13 and a pair of electro-conductive pins 14.

The collar 20 is made of a combination of a metallic portion 21 and a resin portion 22 integrated with the metallic portion 21. A resin described in JP-A No. 2003-161599 can be used as a resin for forming the resin portion 22.

The metallic portion 21 is made of stainless steel or iron, has a shallow cup-shape including a hole on a bottom surface thereof to allow passage of the electro-conductive pins 14, and has an annular bottom surface 23 and a peripheral wall surface 24.

The resin portion 22 has a first cylindrical wall portion 25 that encloses and fixes the ignition portion 13 and the pair of electro-conductive pins 14 of the igniter and a second cylindrical wall portion 38 that forms a space for fitting a connector. An annular convex portion 26 and an annular groove 27 are formed on an outer peripheral surface of the first cylindrical wall portion 25.

A part of the annular bottom surface 23 of the metallic portion 21 is sandwiched between and integrated with the first cylindrical wall portion 25 and the second cylindrical wall portion 38 of the resin portion 22.

Furthermore, an inner peripheral surface of the peripheral wall surface 24 of the metallic portion 21 is contacted by and integrated with the second cylindrical wall portion 38 of the resin portion 22.

The annular groove 27 has an upper annular peripheral surface 28, a lower annular peripheral surface 29, and an annular wall surface 30 that connects the above surfaces 27 and 28. While the lower annular peripheral surface 29 corresponds to a surface of the annular bottom surface 23 of the metallic portion 21 which is not covered by the resin portion 22 in the embodiment shown in FIG. 1, but the lower annular peripheral surface 29 can be covered with the resin portion 22.

The cup-shaped case 40 is made of metal such as stainless steel, iron, and the like and possesses elasticity.

An internal space 40*a* of the cup-shaped case 40 is charged with a gas generating agent (not shown) that is commonly used in a gas generator for an air bag system or a seat belt retractor. The gas generating agent is in contact with the ignition portion 13 of the igniter 12.

The cup-shaped case 40 has a bottom surface 41, a peripheral wall 42, and an opening 43. A fragile portion 41*a* formed by notches or scores are formed on the bottom surface 41. Depending on a device to which the gas generator 10 is applied, the fragile portion may be formed on the peripheral wall 42 instead.

An end of the peripheral wall 42 in the side of the opening 43 is bent inward to form a bent portion 45. The bent portion 45 has an inner opening peripheral edge 46, an inner annular peripheral surface 47, and an annular bent corner portion 48, which are located inside the cup-shaped case 40.

As shown in FIGS. 1 and 2, the cup-shaped case 40 and the collar 20 are abutted against each other as described in (i) to (iii) below. In this case, "abutted" signifies a state of being close contact.

Abutting Embodiment 1

In order to fix the cup-shaped case 40 to the collar 20, (i) the inner opening peripheral edge 46 of the bent portion 45 is abutted against the upper annular peripheral surface 28 of the annular groove 27, (ii) the inner annular peripheral surface 47 of the bent portion 45 is abutted against the annular wall surface 30 of the annular groove 27, and (iii) the annular bent corner portion 48 of the bent portion 45 is abutted against the metallic portion 21 (the annular bottom surface 23) that corresponds to the lower annular peripheral surface 29 of the annular groove 27.

While the cup-shaped case 40 and the collar 20 are favorably abutted against each other as described in (i) to (iii) above, the following embodiments for abutting may be adopted instead.

Abutting Embodiment 2

An embodiment in which the cup-shaped case 40 and the collar 20 are abutted against each other by (i) and (ii).

Abutting Embodiment 3

An embodiment in which the cup-shaped case 40 and the collar 20 are abutted against each other by (i) and (iii).

In a state where the cup-shaped case 40 is mounted to the collar 20 as shown in FIG. 1(*b*), an annular space 50 is formed by the bent portion 45 of the peripheral wall 42 and the first cylindrical wall portion 25. The annular space 50 is communicated with the internal space 40*a*.

Since the cup-shaped case 40 is made of elastic metal, by adjusting an inner diameter size (d1) of the bent portion 45 (the inner annular peripheral surface 47) and an outer diameter size (d2) of the annular wall surface 30 of the annular groove 27 such that the inner diameter size (d1) is slightly smaller than the outer diameter size (d2), the cup-shaped case 40 can be press-fitted into the collar 20 (the resin portion 22). Performing press-fitting in this manner is favorable because fixing strength of the cup-shaped case 40 to the collar 20 can be increased.

The cup-shaped case 40 has protrusions 49 that project inward from the peripheral wall 42 at a location close to the opening 43. The protrusions 49 are constituted by a plurality of independent protrusions arranged in the circumferential direction at regular or appropriate intervals. However, a continuous annular protrusion may be adopted instead. The protrusions 49 are formed so that the annular space 50 and the internal space 40*a* are communicated with each other.

While the protrusions 49 are abutted against the annular convex portion 26 of the first cylindrical wall portion 25 in FIG. 1(*b*), the protrusions 49 need not necessarily be abutted. A height of the protrusions 49 is adjusted so that the gas generating agent does not leak out from the gap between adjacent protrusions 49 to the annular space 50.

Moreover, from the perspective of increasing fixing strength, the cup-shaped case 40 is press-fitted to the collar 20 (the resin portion 22) as described above and desirably, at the same time, the protrusions 49 are also brought into press-contact against the annular convex portion 26.

Next, a method of mounting the cup-shaped case 40 will be described.

The inner diameter size (d1) of the bent portion 45 (the inner annular peripheral surface 47) of the cup-shaped case is adjusted in advance to be slightly smaller than the outer diameter size (d2) of the annular wall surface 30 of the annular groove 27.

As shown in FIG. 1(*a*), as the cup-shaped case 40 is fitted from above onto a member that includes the igniter 12 fixed to the collar 20 (igniter assembly), the bent portion 45 collides with the annular convex portion 26 of the resin portion 22, and after temporarily deforming so as to spread outward, the bent portion 45 deforms inward so as to contract and fits tightly into the annular groove 27 of the resin portion 22 of the collar. At this point, since the relationship as d1<d2 is satisfied, the bent portion 45 (the inner annular peripheral surface 47) is pressed against the annular groove 27 (the annular wall surface 30) and the fixing strength of the cup-shaped case 40 to the collar 20 is increased.

Furthermore, the protrusions 49 of the cup-shaped case are abutted against the annular convex portion 26 of the first cylindrical wall portion 25. At this point, favorably, by adjusting an inner diameter defined by the protrusions 49 (an distance between the protrusions opposite to each other) to be slightly smaller than an outer diameter of the annular convex portion 26 so that the plurality of protrusions 49 are brought into press-contact against the annular convex portion 26, reinforcement can be provided so as to increase the fixing strength of the cup-shaped case 40 to the collar 20.

Next, operations when the gas generator 10 is actuated will be described.

When an ignition current reaches the igniter 12, an explosive of the ignition portion 13 is burnt and combustion products (flames, high-temperature gas, and the like) are generated.

The combustion products ignite the gas generating agent in the internal space 40*a* and generate combustion gas.

As combustion gas is generated in the cup-shaped case 40, pressure inside the cup-shaped case 40 rises and the entire cup-shaped case 40 expands. At this point, the combustion gas also enters the annular space 50. As a result, as indicated by the arrows in FIG. 2, pressure is uniformly applied to an inner wall surface that forms the annular space 50 (in other words, a surface including the inner annular peripheral surface 47 and an inner wall surface of the annular bent corner portion 48).

Therefore, since the generation of the uniform pressure acts to increase a bonding strength (strength of close contact) between the bent portion 45 of the cup-shaped case 40 and the annular groove 27 of the collar 20, gas is prevented from leaking to outside atmosphere from a contact portion of the cup-shaped case 40 and the collar 20 and, at the same time, the cup-shaped case 40 is prevented from detaching from the collar 20.

Subsequently, as the pressure inside the case 40 reaches or exceeds a certain level, the case 40 ruptures at the fragile portion 41*a*, whereby combustion gas and the like is released outside the case 40 to reliably actuate the seat belt retractor.

In the embodiment shown in FIGS. 1 and 2, while the bent portion 45 of the cup-shaped case 40 and the annular groove 27 of the collar 20 are abutted against each other by the "abutting embodiment 1" described above, a similar effect is achieved by adopting the abutting embodiment 2 or 3 due to pressure being uniformly applied to the inner wall surface of the annular space 50 as indicated by the arrows in FIG. 2.

Figure 3:
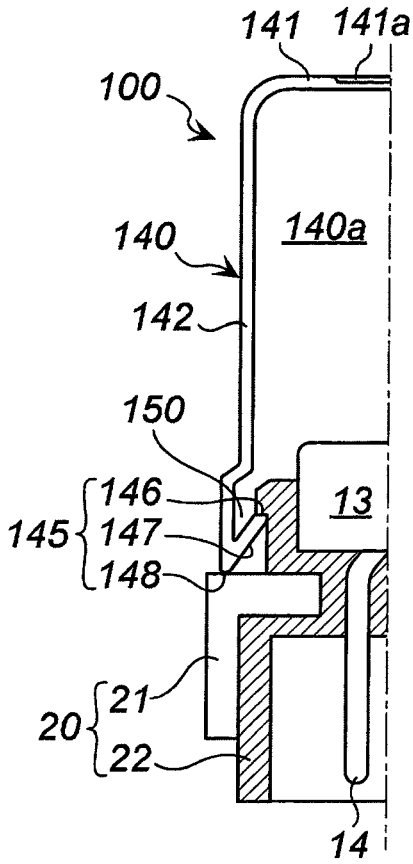
FIG. 3 shows an axial half cross-sectional view of another embodiment of a gas generator according to the present invention.

(2) Gas Generator Shown in FIG. 3

While a gas generator 100 shown in FIG. 3 differs from the gas generator 10 shown in FIGS. 1 and 2 in a shape of a bent portion of a cup-shaped case, other portions including those not denoted by reference numerals are the same as those of the gas generator 10 shown in FIGS. 1 and 2.

A cup-shaped case 140 has a bottom surface 141, a peripheral wall 142, and an opening. A fragile portion 141*a* formed by notches or scores are formed on the bottom surface 141. Depending on a device to which the gas generator 100 is applied, the fragile portion may be formed on the peripheral wall 142 instead. An internal space 140*a* is charged with a gas generating agent. Moreover, the protrusions 49 formed on the cup-shaped case 40 shown in FIG. 1 may also be provided.

An end of the peripheral wall 142 in the opening side is bent inward to form a bent portion 145. The bent portion 145 has an inner opening peripheral edge 146, an inner annular peripheral surface 147, and an annular bent corner portion 148, which are located inside the cup-shaped case 140.

In the gas generator 100 shown in FIG. 3, the inner opening peripheral edge 146 of the bent portion 145 is abutted against an upper annular peripheral surface 28 of an annular groove 27 and the annular bent corner portion 148 of the bent portion 145 is abutted against a metallic portion 21 corresponding to a lower annular peripheral surface 29 of the annular groove 27 (an annular bottom surface 23) to fix the bent portion 145 of the peripheral wall 142 of the cup-shaped case 140 and the annular groove 27 of the collar 20 to each other (the abutting embodiment 3 described earlier).

In the gas generator 100 shown in FIG. 3, an annular space 150 that communicates with the internal space 140*a* is formed by the bent portion 145 of the peripheral wall 142 of the cup-shaped case 140 and the collar 20 (a resin portion 22).

When the gas generator 100 shown in FIG. 3 is actuated, gas pressure is uniformly applied to an inner wall surface of the annular space 150. Therefore, a similar operational advantage as that of the gas generator 10 shown in FIGS. 1 and 2 may be achieved.

Figure 4:
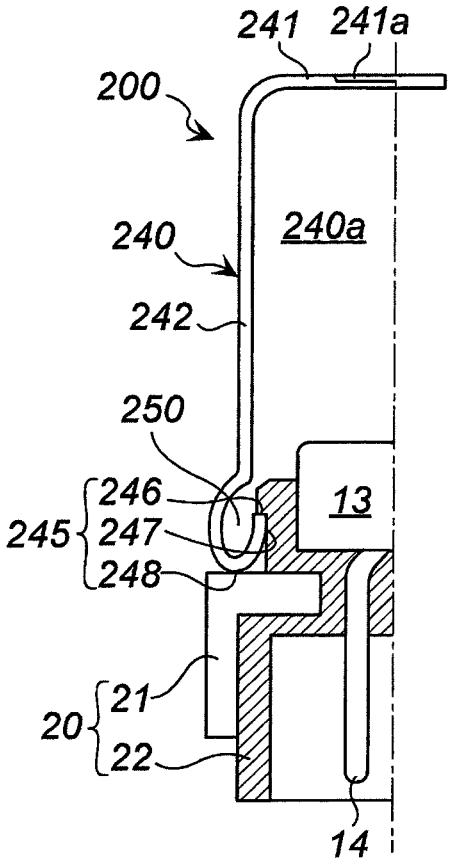
FIG. 4 shows an axial half cross-sectional view of still another embodiment of a gas generator according to the present invention.

(3) Gas Generator Shown in FIG. 4

While a gas generator 200 shown in FIG. 4 differs from the gas generator 10 shown in FIGS. 1 and 2 in a shape of a bent portion of a cup-shaped case, other portions including those not denoted by reference numerals are the same as those of the gas generator 10 shown in FIGS. 1 and 2.

A cup-shaped case 240 has a bottom surface 241, a peripheral wall 242, and an opening. A fragile portion 241*a* formed by notches or scores are formed on the bottom surface 241. Depending on a device to which the gas generator 200 is applied, the fragile portion may be formed on the peripheral wall 242 instead. An internal space 240*a* is charged with a gas generating agent. Moreover, the protrusions 49 formed on the cup-shaped case 40 shown in FIG. 1 may also be provided.

An end of the peripheral wall 242 in the opening side is bent inward to form a bent portion 245. The bent portion 245 has an inner opening peripheral edge 246, an inner annular peripheral surface 247, and an annular bent corner portion 248, which are located inside the cup-shaped case 240. The bent portion 245 is formed rounded compared to that shown in FIGS. 1 and 2.

In the gas generator 200 shown in FIG. 4, the inner opening peripheral edge 246 of the bent portion 245 is abutted against an upper annular peripheral surface 28 of an annular groove 27, the inner annular peripheral surface 247 of the bent portion 245 is abutted against an annular wall surface 30 of the annular groove 27, and the annular bent corner portion 248 of the bent portion 245 is abutted against a metallic portion 21 corresponding to a lower annular peripheral surface 29 of the annular groove 27 (an annular bottom surface 23) to fix the bent portion 245 of the cup-shaped case 240 and the annular groove 27 of the collar 20 to each other (the abutting embodiment 1 described earlier).

In the gas generator 200 shown in FIG. 4, an annular space 250 that communicates with the internal space 240*a* is formed by the bent portion 245 of the peripheral wall surface 242 of the cup-shaped case 240 and the collar 20 (a resin portion 22).

When the gas generator 200 shown in FIG. 4 is actuated, gas pressure is uniformly applied to an inner wall surface of the annular space 250. Therefore, a similar operational advantage as that of the gas generator 10 shown in FIGS. 1 and 2 may be achieved.

Figure 5:
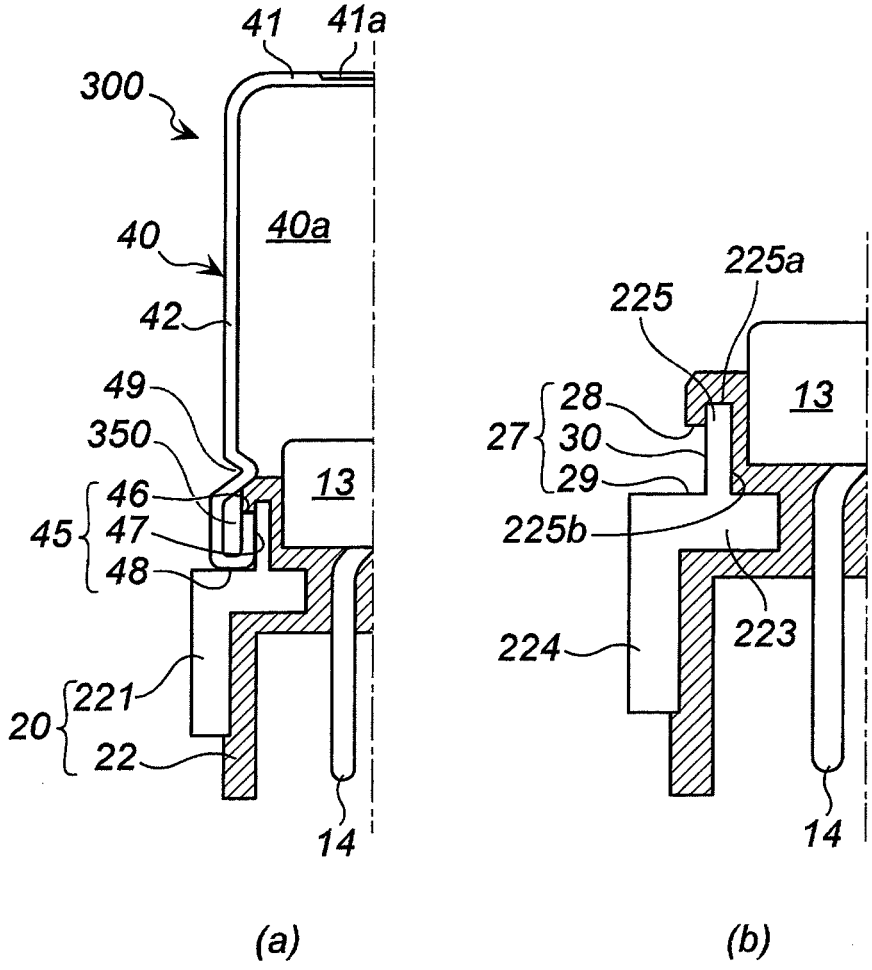
FIG. 5 shows still another embodiment of a gas generator according to the present invention.

(4) Gas Generator Shown in FIG. 5

While a gas generator 300 shown in FIGS. 5(*a*) and (*b*) differs from the gas generator 10 shown in FIGS. 1 and 2 in a structure of a collar, other portions including those not denoted by reference numerals are the same as those of the gas generator 10 shown in FIGS. 1 and 2.

A metallic portion 221 is made of stainless steel or iron and has a shallow cup-shape with a hole opened on a bottom surface thereof. While the metallic portion 221 has an annular bottom surface 223 and a peripheral wall surface 224 in the same manner as the metallic portion 21 shown in FIG. 1, the metallic portion 221 differs from the metallic portion 21 shown in FIG. 1 in that the metallic portion 221 has a cylindrical wall surface 225 projected from the annular bottom surface 223 toward a side opposite to the peripheral wall surface 224.

With the cylindrical wall surface 225, a side of an end portion 225*a* is embedded into a resin portion 22 and an inner peripheral surface 225*b* is in contact with the resin portion 22.

While an annular groove 27 shown in FIG. 5 has a same structure and a same shape as that shown in FIGS. 1 and 2, the annular groove 27 shown in FIG. 5 differs from that shown in FIG. 1 in that an annular wall surface 30 is formed with a cylindrical wall surface 225 of the metallic portion, and a lower annular peripheral surface 29 is formed with the annular bottom surface 223 of the metallic portion, although an upper annular peripheral surface 28 is formed with the resin portion 22.

In the gas generator 300 shown in FIG. 5, an annular space 350 that communicates with an internal space 40*a* is formed by the bent portion 45 of the peripheral wall 42 of the cup-shaped case 40 and the collar 20 (the resin portion 22).

When the gas generator 300 shown in FIG. 5 is actuated, gas pressure is uniformly applied to an inner wall surface of the annular space 350. Therefore, a similar operational advantage as that of the gas generator 10 shown in FIGS. 1 and 2 may be achieved.

Moreover, the gas generators shown in FIGS. 1 to 5 described above can be also used as an ignition device for an airbag gas generator disclosed in FIG. 3 in JP-A No. 2004-217059.

The invention thus described, it will be obvious that the same may be varied in many ways. Such variations are not to be regarded as a departure from the sprit and scope of the invention, and all such modifications as would be obvious to one skilled in the art are intended to be included within the scope of the following claims.

The invention claimed is:

1. A gas generator comprising: an igniter, a collar for holding the igniter and a cup-shaped case fixed to the collar and charged inside with a gas generating agent, the collar formed by a combination of a metallic portion and a resin portion which is integrated with the metallic portion, the collar being provided with an annular groove formed in an outer peripheral surface thereof, the cup-shaped case and the collar being fixed by fitting a bent portion, which is obtained by bending inward an end portion in an opening side of the cup-shaped case, to the annular groove, an annular space being formed by an inner wall surface of the bent portion and the collar, and being in communication with an inside of the cup-shaped case, wherein the bent portion comprises an inner opening peripheral edge, an inner annular peripheral surface, and an annular bent corner portion, which are located inside the cup-shaped case.

2. The gas generator according to claim 1, wherein the annular groove of the collar comprises an upper annular peripheral surface, a lower annular peripheral surface and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove and abutting the annular bent corner portion of the bent portion against the lower annular peripheral surface of the annular groove.

3. The gas generator according to claim 2, wherein the annular groove of the collar includes an upper annular peripheral surface, a lower annular peripheral surface and an annular wall surface connecting the upper annular peripheral surface and the lower annular peripheral surface, and at least one of the annular wall surface and the lower annular peripheral surface is formed with the metallic portion of the collar.

4. The gas generator according to claim 1, wherein the annular groove of the collar comprises an upper annular peripheral surface, a lower annular peripheral surface and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove and abutting the inner annular peripheral surface of the bent portion against the annular wall surface of the annular groove.

5. The gas generator according to claim 1, wherein the annular groove of the collar comprises an upper annular peripheral surface, a lower annular peripheral surface and an annular wall surface connecting the upper annular peripheral surface and the lower annular peripheral surface, and the cup-shaped case and the collar are fixed by abutting the inner opening peripheral edge of the bent portion against the upper annular peripheral surface of the annular groove, abutting the inner annular peripheral surface of the bent portion against the annular wall surface of the annular groove, and abutting the annular bent corner portion of the bent portion against the lower annular peripheral surface of the annular groove.

6. The gas generator according to claim 1, wherein the cup-shaped case has a plurality of protrusions projected inward from a peripheral wall portion thereof, and the plurality of protrusions are abutted against the collar.

7. The gas generator according to claim 1, further comprising:

a plurality of protrusions provided in a peripheral wall portion of the cup-shaped case;

a cylindrical wall portion provided in the resin portion for enclosing and fixing an igniter portion of the igniter, the cylindrical wall portion including an annular convex portion formed on an outer peripheral surface thereof, wherein an inner diameter defined by the protrusions is slightly smaller than an outer diameter of the annular convex portion.

8. The gas generator according to claim 7, wherein the cup-shaped case is fixed to the collar such that the protrusions are brought into press-contact against the annular convex portion.

* * * * *